US005605259A

United States Patent [19]

Clawson et al.

[11] Patent Number: 5,605,259

[45] Date of Patent: Feb. 25, 1997

[54] METHOD AND APPARATUS FOR COVERING IRREGULARITIES IN A WALL SURFACE

[75] Inventors: Ross W. Clawson; Lester R. Greer, Jr.; Robert C. Foster, all of Bellingham, Wash.

[73] Assignee: Homax Products, Inc., Bellingham, Wash.

[21] Appl. No.: 418,753

[22] Filed: Apr. 7, 1995

[51] Int. Cl.[6] ..... B65D 83/46

[52] U.S. Cl. ..... 222/402.23; 222/192; 222/389; 222/402.1; 239/DIG. 12; 401/190

[58] Field of Search ..... 222/192, 387, 222/389, 394, 402.1, 402.21, 402.22, 402.23; 401/190; 239/592, 601, DIG. 12

[56] References Cited

U.S. PATENT DOCUMENTS

| | | | |
|---|---|---|---|
| 2,612,293 | 9/1952 | Michel | 222/402.23 X |
| 2,895,650 | 7/1959 | Mahon et al. | 222/389 X |
| 3,032,803 | 5/1962 | Walshauser | 401/190 |
| 3,350,159 | 10/1967 | Rice, Jr. | 401/190 |
| 3,405,845 | 10/1968 | Cook et al | 222/387 |
| 3,513,886 | 5/1970 | Easter et al. | 222/402.22 X |
| 5,277,336 | 1/1994 | Youel | 222/402.1 X |
| 5,341,970 | 8/1994 | Woods | 401/190 X |

FOREIGN PATENT DOCUMENTS

| | | | |
|---|---|---|---|
| 8904796 | 6/1989 | WIPO | 222/192 |

*Primary Examiner*—Joseph Kaufman
*Attorney, Agent, or Firm*—Hughes, Multer & Schacht, P.S.

[57] ABSTRACT

A method and apparatus for applying drywall compound to an irregularity in a wall surface. The drywall compound is formulated to be flowable and placed into an aerosol container with a propellant material. A valve assembly is arranged to allow or prevent fluid flow from the aerosol container. When the valve assembly is opened, the aerosol material expands to force the drywall compound out of the container. A scraper member is arranged on the container to facilitate smoothing of the drywall compound; preferably, the scraper member comprises a scraper edge that is arranged adjacent to an exit opening such that the drywall compound can be dispensed and scraped at the same time.

3 Claims, 9 Drawing Sheets

C
254
244
242
A
301
24
252
306
282
304
230
220
234
F
262
302
50
26
264
232
222
270

METHOD AND APPARATUS FOR COVERING IRREGULARITIES IN A WALL SURFACE

TECHNICAL FIELD

The present invention relates to methods and apparatus for covering imperfections or irregularities in wall surfaces or the like and, more particularly, such methods and apparatus adapted for use by nonprofessionals.

BACKGROUND OF THE INVENTION

In modern home construction, interior walls are generally formed by sheets of drywall material sold in standard sizes. These sheets of drywall material are cut, if necessary, and screwed to the house frame. The junctures of adjacent sheets of drywall material are taped, drywall compound is applied over the taping, and, usually, a texture material is applied to the entire wall surface to hide any imperfections in the surface and present a pleasing aesthetic effect. The entire surface is then painted and trimmed.

Under normal use, such walls may be damaged by, for example, screws or nails used to hang pictures and the like, accidental impact of hard objects, and the settling of the frame on which the wall is formed. Any of these events may cause holes, gouges, and cracks that mar the appearance of the wall. Any damage that mars the normal appearance of a wall surface or the like will be referred to herein as an irregularity.

To cover such an irregularity, drywall compound may be applied over the irregularity or a patch covering the irregularity and allowed to dry. A suitable base is thus formed for the application of new texture material, if necessary, and paint to obtain a wall surface at the irregularity that closely approximates that of the remaining wall surface.

Heretofore, such drywall compound has been purchased in premixed form in cans or other containers or in dry form to be mixed with water. When applied, such drywall compound is normally in a nonflowable, almost gel-like state. A portion of the drywall material slightly greater than that required to fill the irregularity is applied over the irregularity and smoothed with a flat-bladed tool such as a trowel, putty knife, scraper, or the like. The same tool is often used both to apply the drywall compound onto the irregularity and to scrape over the drywall compound to obtain a smooth, flat surface.

In many situations, the results obtained by the just-described process are satisfactory. In the case of cracks and the like, the underlying cause of the crack may continue, resulting in further cracking that may need an additional coat of drywall compound.

The drywall compound itself is relatively inexpensive and thus is often sold in fairly large containers. The storage of these containers can be somewhat inconvenient, especially for apartment dwellers.

Additionally, as at least one additional tool is often used during this process, it is often necessary to gather together several different items before damage to a wall may be repaired. In a nonprofessional setting, the gathering of the items necessary to repair the wall can be inconvenient and cause such repair to be deferred.

Accordingly, while the results of the method described above of repairing walls are generally acceptable, the need nonetheless exists for a product with improved capability to cover irregularities and that may be applied in a more convenient method. The need further exists that will allow professionals to perform repairs and even original application of drywall compound on a small scale basis in a convenient manner.

OBJECTS OF THE INVENTION

From the foregoing, it should be clear that one primary object of the invention is to provide improved methods and devices for applying drywall compound material to a wall or the like to cover irregularities in the surface of such walls.

Another more specific object of the present invention is to obtain methods and apparatus for covering irregularities in walls or the like having a favorable mix of the following characteristics:

(a) convenience of storage and use for all end users, but especially for a non-professional with limited need for repairing wall surfaces;

(b) improved ability to cover cracks and other irregularities that get progressively worse over time; and (c) inexpensive to fabricate.

SUMMARY OF THE INVENTION

The present invention in its most basic form comprises the use of a flowable drywall compound in an aerosol container. A propellant material is introduced into the container with the flowable drywall compound, and a valve assembly is arranged such that, when opened, the propellant material forces the flowable drywall compound out of the aerosol container.

Preferably, a scraper member is provided to allow the drywall compound to be scraped flat as it is dispensed from the container. In one exemplary configuration, the drywall compound flows through a scraper passageway defined in the scraper member. The scraper member preferably has a small cavity formed therein between the scraper member and the wall surface being repaired to facilitate the application of drywall compound. The scraper member may also be configured to apply drywall compound to a corner area or in a reversible manner that allows the scraper member to be used both on flat walls and in corners.

It is also possible that the scraper member may be made a part of the actuator system for the valve assembly. However, the scraper member may be rigidly connected to the aerosol container such that the actuator for the valve assembly is moved independently of the scraper member.

In one configuration, the propellant material may be in direct contact with the flowable drywall compound. In another configuration, however, a partitioning member such as a piston or an internal product bag may be provided to separate the drywall compound from the propellant material.

DETAILED DESCRIPTION OF THE INVENTION

Figure 1:
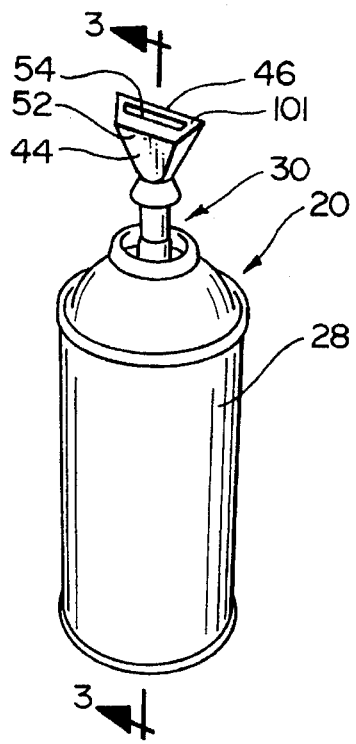
FIG. 1 is a perspective view showing an aerosol device constructed in accordance with, and embodying, the principles of the present invention.

Referring now to the drawing, depicted therein at 20 is an aerosol device constructed in accordance with, and embodying, the principles of the present invention. The aerosol device 20 comprises drywall compound 22 that is dispensed to cover an imperfection 24 in a wall 26 or the like.

Figure 3:
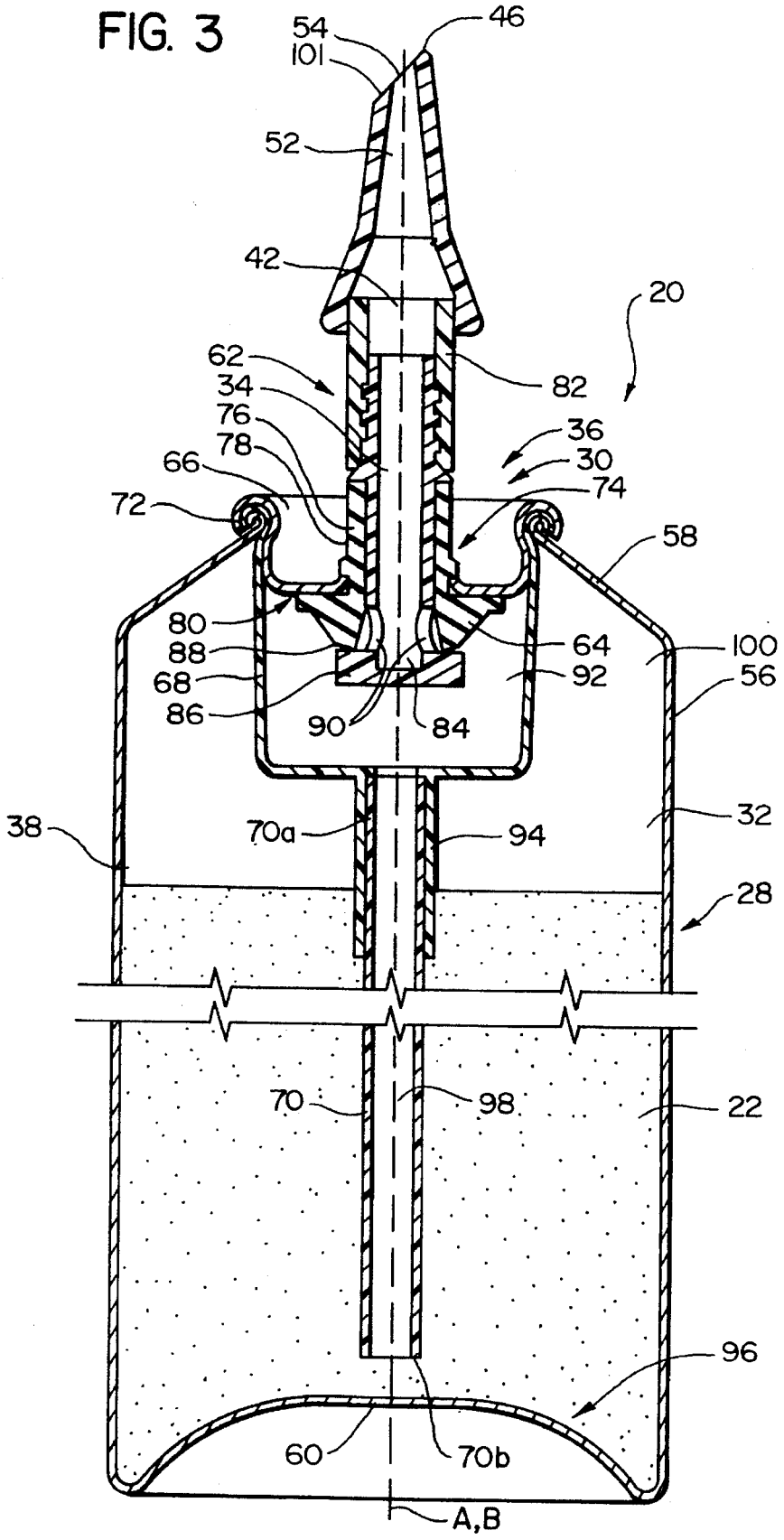
FIG. 3 is a section view taken along lines 3—3 in FIG. 1.
Figure 4:
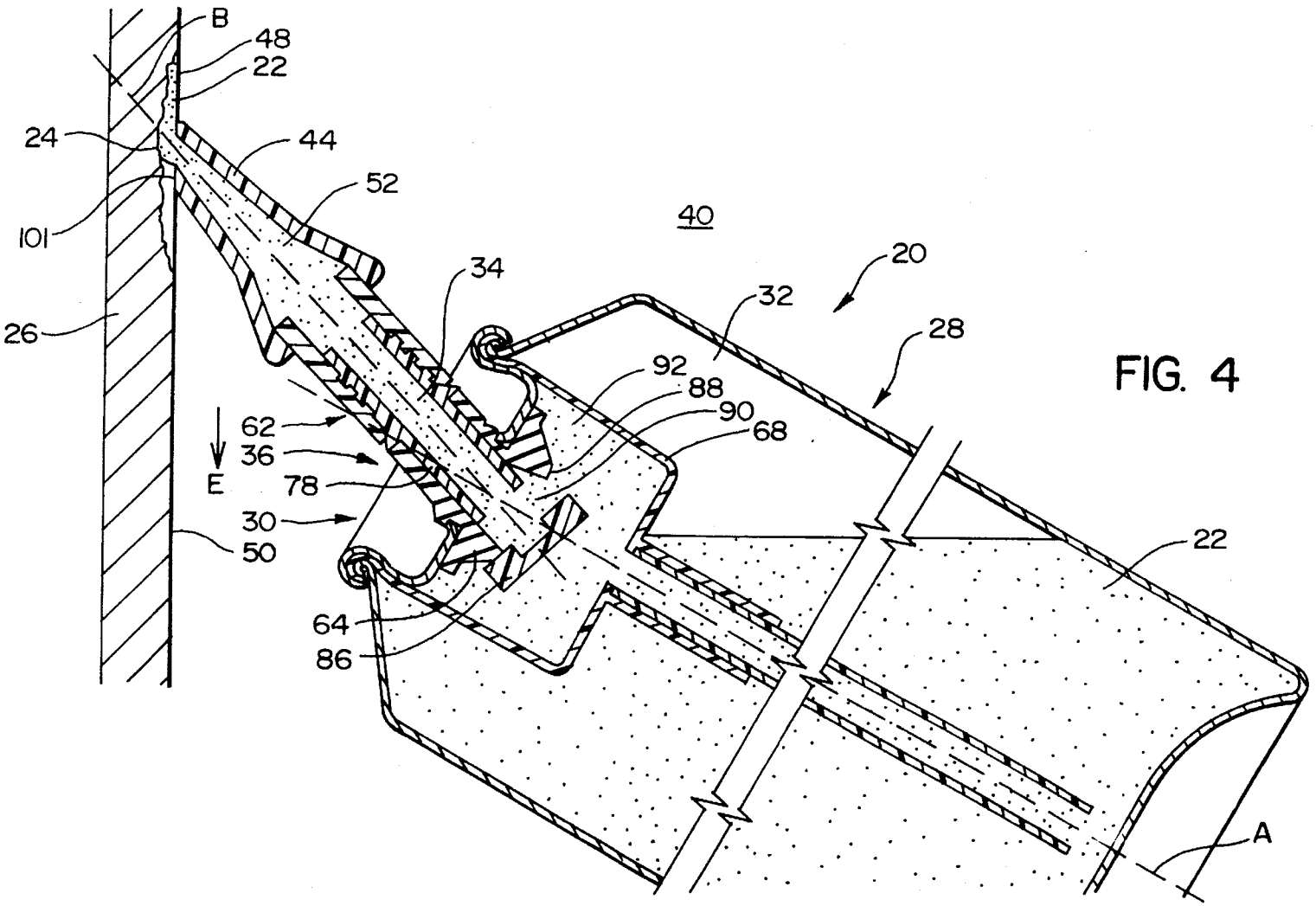
FIG. 4 is a section view taken along lines 4—4 in FIG. 2.

In addition to the drywall compound 22, the aerosol device 20 basically comprises an aerosol container 28, a valve assembly 30, and a propellant material 32 (FIGS. 3 and 4).

The valve assembly 30 defines an exit passageway 34. The valve assembly 30 is manually operable between a closed position as shown in FIG. 3 and an open position as shown in FIG. 4. In the closed position shown in FIG. 3, passage of fluids through the exit passageway is prevented; while in the open position shown in FIG. 4, fluids are allowed to pass through the exit passageway 34.

In the exemplary aerosol device 20, the valve assembly 30 is arranged in a valve opening 36 formed in the aerosol container 28 such that the exit passageway 34 extends through this opening 36. Accordingly, when the valve assembly 30 is in the open position as shown in FIG. 4, drywall compound 22 may flow through the exit passageway 34 to the exterior 38 of the aerosol container 28.

The exemplary propellant material 32 is formed by a compressed, substantially inert gas such as oxygen or nitrogen that expands when pressure thereon is released. In the context of the aerosol device 20 described herein, placement of the valve assembly 30 into the open position shown in FIG. 4 allows the propellant material 32 to expand and force the wet drywall compound 22 from the main chamber 38 to the exterior 40 of the aerosol container 28 through the exit passageway 34.

Figure 2:
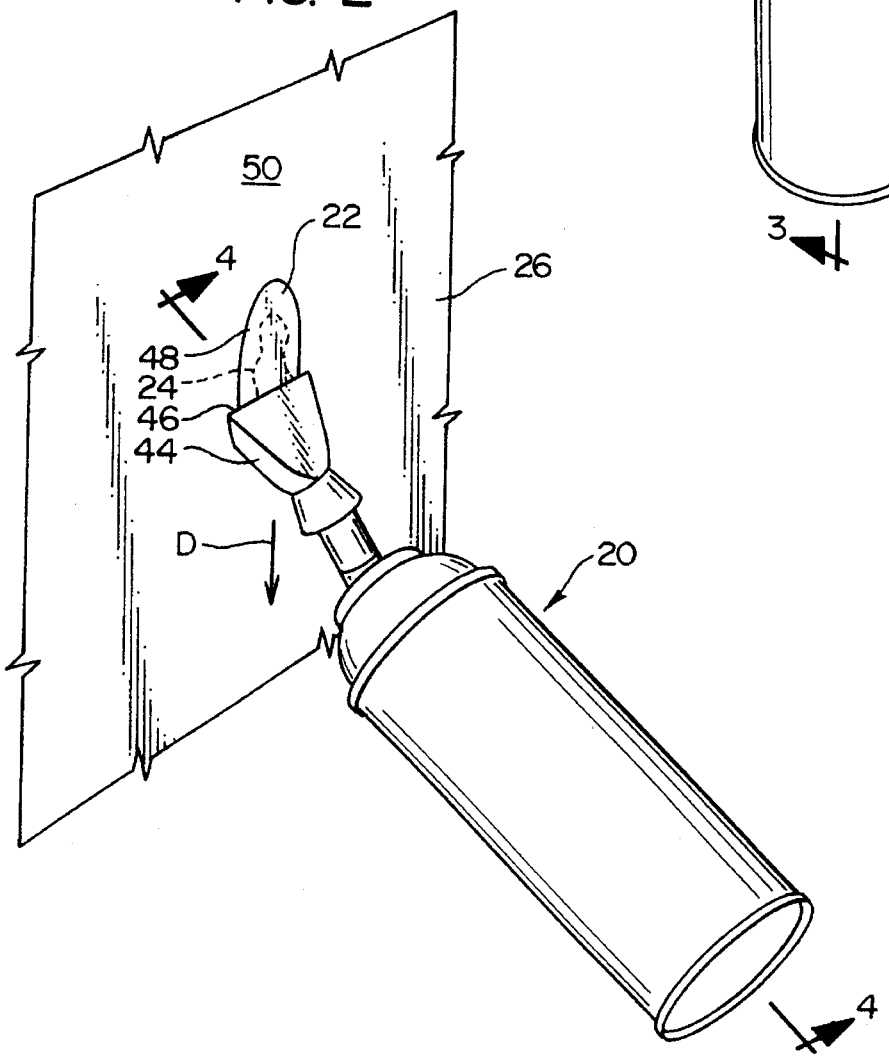
FIG. 2 depicts the aerosol device of FIG. 1 in use.

By appropriately arranging an exterior end 42 of the exit passageway 34 adjacent to the irregularity 24 as shown in FIG. 2, the wet drywall compound 22 may be applied over this irregularity 22.

The exemplary aerosol device 20 also further comprises a scraper nozzle 44 connected to the aerosol container 28. The scraper nozzle 44 has a scraper edge 46 formed thereon. When the wet drywall compound 22 is dispensed onto the irregularity 24, the scraper edge 46 may be brought into contact with the wet drywall compound 22 to smooth this material 22. When the wet drywall material dries, its surface 48 is smooth and flat. The surface 48 may then be painted, or, prior to painting, texture material may be applied thereto to match the surrounding surface 50 of the wall 26.

To facilitate the scraping action shown in FIGS. 2 and 4, the exemplary scraper nozzle 44 is provided with a scraper passageway 52 in communication with the exterior end 42 of the exit passageway 34. The wet drywall compound material 22 thus passes through this scraper passageway 52 as it is dispensed to an exit opening adjacent to the scraper edge 46. With this arrangement, the drywall compound material 22 may be dispensed and scraped with one easy motion.

The exemplary scraper passageway 52 is narrowed in one dimension as shown in FIGS. 3 and 4 and flared in another dimension as shown in FIG. 1 such that the exit opening 54 is an elongate slot arranged parallel to, and spaced a short distance from, the scraper edge 46. With the exit opening 54 just described, the drywall compound material is dispensed in a thin stream or ribbon that is highly appropriate for covering an irregularity 24 while allowing the scraper edge 46 to form the smooth surface 48. However, other configurations of exit openings may be employed as will be described in detail below.

a. First Embodiment

Referring now to FIG. 3, the details of construction of the first embodiment of the present invention will be presented in further detail. The aerosol container 28 comprises a generally cylindrical side wall 56, a frustoconical upper wall 58, and a concave bottom wall 60. A center axis A of the aerosol device 20 is defined by the axis of the cylindrical sidewalls 56.

The valve opening 36 described above is formed in the upper wall 58. The valve opening 36 30 is circular, and the axis thereof is aligned with the axis A of the device 20.

The valve assembly 30 basically comprises a valve stem assembly 62, a resilient member 64, a valve cap 66, a valve housing 68, and a dip tube 70.

The valve cap 66 and valve housing 68 are adapted to engage an upper edge 72 of the upper wall 58 in a manner that yields a fluid-tight seal along an annular juncture formed along this edge 72.

The valve cap 66 has a valve hole 74 formed therein through which the valve stem assembly 62 extends. The resilient member 64 also extends through this valve hole 74 between the mounting cap 66 and the valve stem assembly 62. In particular, the resilient member 64 has a generally cylindrical upper portion 76 that sealingly engages an inner member 78 of the valve stem assembly 62. The resilient member 64 also has a cap engaging portion 80 that engages the valve cap 66 in a fluid tight manner. Accordingly, the resilient member 64 prevents fluids within the aerosol container 28 from reaching the exterior 40 by passing between the valve cap 66 and the valve stem assembly 62.

The valve stem assembly 62 comprises the inner member 78 just described and an upper member 82. The inner member 78 and upper member 82 are threaded to mate with each other to form the assembly 62. The exit passageway 34 extends through the center of the valve stem assembly 62 formed by the inner member 78 and the upper member 82. An exit axis B is defined by the center axis of the upper member 82.

At an interior end 84 of the exit passageway 34, a valve plate 86 is formed on the inner member 78. This valve plate 86 engages an annular valve seat 88 formed on the resilient member 64 to establish a fluid-tight seal between the plate 86 and the resilient member 64. Holes 90 are formed at the lower end of the inner member 78.

When the valve assembly 30 is in its closed position as shown in FIG. 3, the axes A and B described above are aligned. However, referring now for a moment to FIG. 4, it can be seen that the valve stem assembly 62 has been moved such that the exit axis B is no longer aligned with the center axis A. In this position, at least a portion of the valve plate 86 is no longer in contact with the valve seat 88, which allows fluid communication between the exit passageway 34 and a valve chamber 92 defined by the valve housing 68 through the openings 90 in the inner member 78 of the valve stem assembly 62.

Additionally, also as shown in FIG. 4, the resilient member 64 is distorted when the valve assembly 30 is in the open position. The resilient member 64, when distorted, exerts a force on the valve stem assembly 62 that biases this assembly 62 to align the exit axis B with the center axis A. Accordingly, if external pressure is removed from the valve stem assembly 62, the resilient member 64 essentially becomes a spring that forces the valve stem assembly 62 into a position in which the valve plate 86 engages the valve seat 88 in a fluid-tight manner.

The resilient member 64 thus provides three functions: (a) it acts as a spring to bias the valve assembly 30 into its closed position; (b) it establishes a valve seat to prevent fluid flow from the main chamber 38 into the exit passageway 34 when the valve assembly 30 is in its closed position; and (c) it provides a fluid-tight seal between the valve stem assembly 62 and the valve cap 66.

A first end 70a of the dip tube 70 is received in a mounting portion 94 of the valve housing 68. A second end 70b thereof extends into a lowermost region 96 of the main chamber 38. The only fluid communication between the valve chamber 92 and the main chamber 38 is through the dip tube 70.

When the aerosol container 28 is upright as shown in FIG. 3, the dip tube 70 extends through the propellant material 32 and into the drywall compound 22 at the lowermost region 96 of the main chamber 38. Pressure exerted by the propellant material 32 on the drywall compound 22 forces this material 22 up into the valve chamber 92 through the dip tube 70.

Accordingly, as the propellant material 32 expands, substantially all of the drywall compound 22 may be forced out of the aerosol container 28 through the initial passageway 96, the valve chamber 92, the openings 90, and the exit passageway 34.

In the exemplary aerosol device 20 described above, the propellant material 32 is lighter than the drywall compound 22, and thus accumulates in an upper portion 100 of the container 28 when the container 28 is upright. The propellant material is preferably a compressed substantially inert gas such as air or nitrogen that will not react with the drywall compound 22. By introducing the drywall compound 22 first into the container 28 and then adding pressurized propellant material 32, the propellant material 32 will expand when the valve assembly 30 is opened to force the drywall compound 22 out of the container 28 as described above.

A surface 101 formed on the scraper member 44 is canted with respect to the exit axis B of the aerosol device 20. The exit opening 54 is formed in this surface 101, and the scraper edge 46 borders one side of the surface 101. The angle between the surface 101 and the exit axis B should be such that, when the drywall compound 22 is being dispensed, the surface 101 is parallel or close to parallel with the surface 50 of the wall 26.

The drywall compound 22 is formed of the same basic materials as prior art drywall compounds. However, the applicants have discovered that additional quantities of water should be added to lower the viscosity of the drywall compound 22, thereby allowing it to flow out of the aerosol container 28 as described above.

Additionally, the exemplary drywall compound 22 described herein may additionally comprise a latex-based material which gives the drywall compound 22 some resiliency when it is dry. This latex material is optional, but the flexibility provided thereby helps to counteract the cracking that tends to occur with higher water content of the drywall material 22, and also gives this dried drywall compound material additional ability to expand to accommodate irregularities formed by slowly widening cracks.

The current preferred composition of the drywall material 22 comprises drywall compound material, an elastomeric material, a defoamer, and water. In particular, the drywall material 22 comprises 64 parts of a drywall compound material commercially available from the Homax Corporation, assignee of the present application, as SMOOTH AND LITE (item #5560), 4 parts acrylic latex caulk available from DAP as ALEX PAINTER'S ACRYLIC LATEX, 2 parts water, and 1 part FOAMASTER 11119A available from the Henkel Corporation.

In this application, the terms "wet drywall compound" "wet drywall material" "drywall compound", and "drywall material" are used interchangeably to describe the flowable drywall material 22 that forms a part of and is dispensed by the aerosol device 20. This "wet" or "flowable" material is distinguished from the dry or solid layer of drywall compound formed after the wet material has been dispensed and allowed to dry.

b. Second Embodiment

Figure 5:
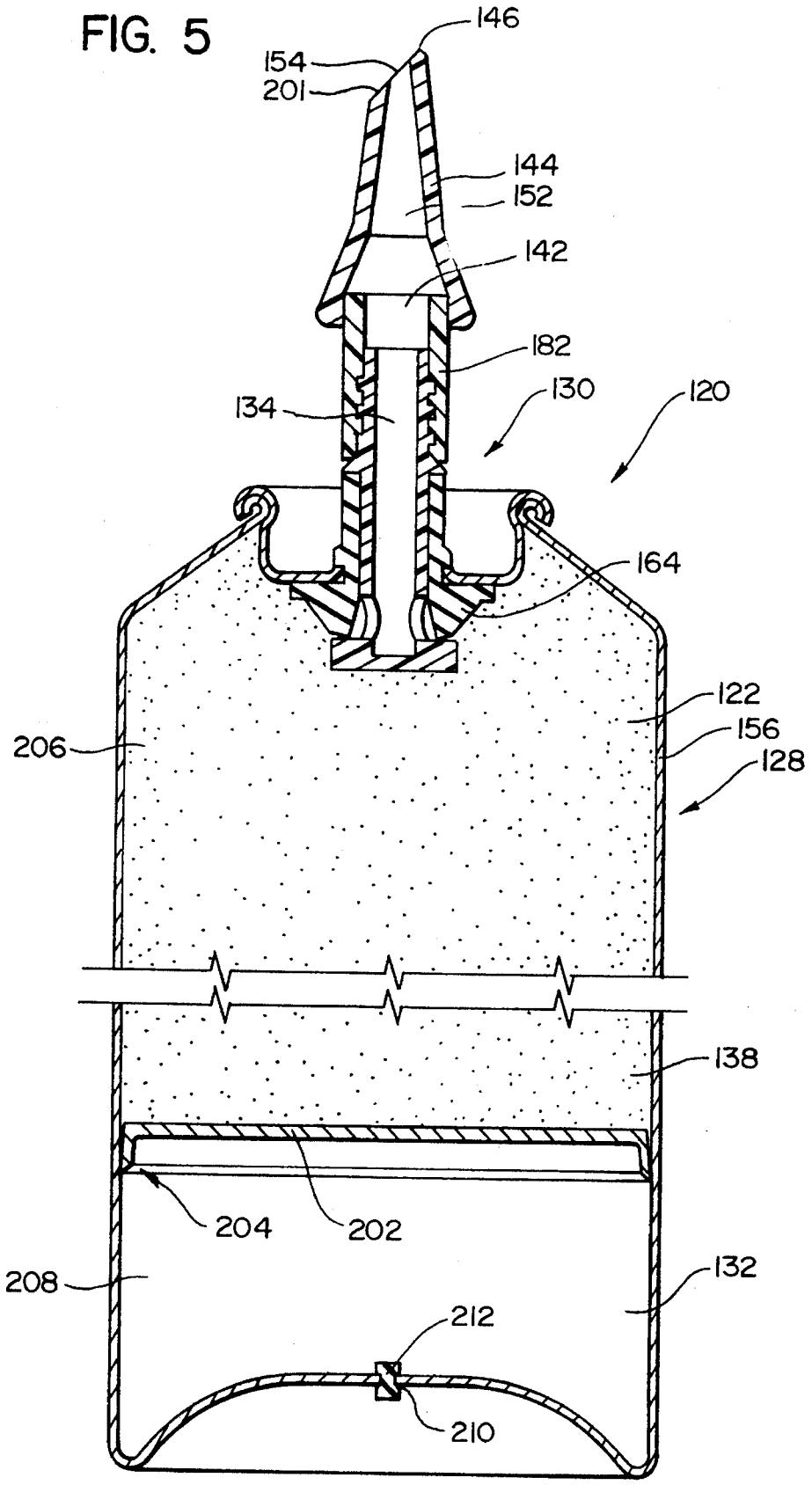
FIG. 5 is a side, cut-away view of a second embodiment of the present invention showing a propellant system using a piston.

Referring now to FIG. 5, depicted therein at 120 is another exemplary aerosol device constructed in accordance with, and embodying, the principles of the present invention. This device 120 is similar to the device 20 described above, and the device 120 will be described herein only to the extent that it differs from the device 20. Components of the device 120 that are the same as those of the device 20 will be given the same reference characters plus 100.

The aerosol device 120 differs from the aerosol device 20 described above primarily in that the device 120 uses a propulsion system having a piston 202. The piston 202 is a disc-shaped member the diameter of which is slightly smaller than the inner diameter of the side wall 156 of the aerosol container 128. An annular seal 204 is formed at the juncture of the piston 202 and the side wall 156 to inhibit fluid flow through this juncture.

The piston 202 divides the main chamber 138 into a drywall compound chamber 206 and a propellant chamber 208. The piston 202 obviates the need for a valve housing and dip tube by allowing the drywall compound 122, which is heavier, to be arranged above the lighter propellant. Because of the piston 202, a fill hole 210 and plug 212 are provided in the bottom wall to allow the propellant material 132 to be introduced into the container 128.

The piston 202 also allows the aerosol device 120 to be used in any arbitrary orientation. In contrast, the aerosol device 20 described above must be basically upright when used. If the aerosol device 20 is inverted or simply tipped too far over, the propellant material 32 will pass out of the aerosol container 28 and leave a large amount of drywall compound 22 undispensed.

If the piston 202 is employed, the propellant material 132 may be a fluid such as hydrocarbon liquids or the like which start out in a liquid phase and gassify as pressure thereon is reduced. As the valve assembly 130 is placed into the open position, such materials gassify, expand, and act against the piston 202 and force the drywall compound 122 out of the container 128. However, in this case, the seal 204 must be highly effective to prevent the propellant material 132 from mixing with the drywall compound 122.

A perhaps more preferred material to be used as the propellant material 132 may be compressed inert gasses such as air or nitrogen. Such compressed inert gasses also expand to act on the piston 202 to force out the drywall compound 122 when the valve assembly 130 is placed in the open position. Additionally, slight leakage may occur through the seal 204 without adversely affecting the drywall compound 122.

When the piston 202 is used, water should be added to the drywall compound 122 just to the point where its viscosity is low enough to allow the drywall compound 122 to flow through the valve assembly 130; the drywall compound 122 should, however, retain a somewhat gel-like consistency. This fairly viscous gel-like consistency will allow the drywall compound 122 to form a self-seal at the juncture of the piston 202 and the side wall 156; with such a self-seal, should the annular seal 204 not be highly reliable, the drywall compound 122 itself will engage the container side wall 156 to inhibit mixing of the drywall compound 122 with the propellant material 132.

As an alternative to the piston 202, a product bag may be employed. A product bag performs the same basic function of separating the drywall compound 122 from the propellant material 132, but the seal between the product bag and the aerosol container is easier to maintain. A spring or other structural member may be included within the bag to cause it to collapse in a predictable manner that does not block exit of the drywall compound 122.

c. Third Embodiment

Figure 6:
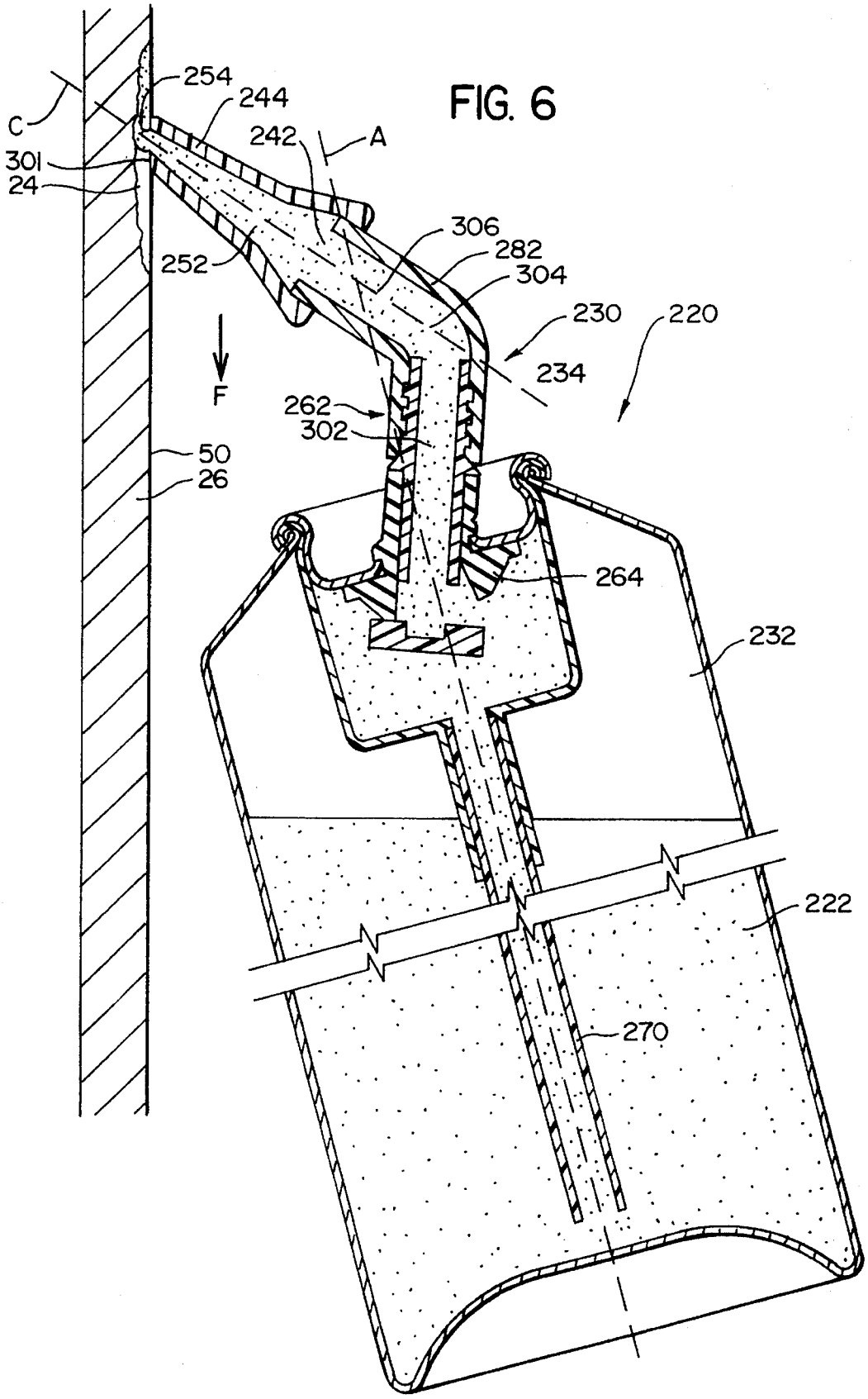
FIG. 6 is a side, cut-away view of a third embodiment of the present invention having a scraper/nozzle angled with respect to the axis of the aerosol container.

Referring now to FIG. 6 depicted therein at 220 is another exemplary aerosol device constructed in accordance with, and embodying, the principles of the present invention. This device 220 is similar to the device 20 described above, and the device 220 will be described herein only to the extent that it differs from the device 20. Components of the device 220 that are the same as those of the device 20 will be given the same reference characters plus 200.

The aerosol device 220 differs from the aerosol device 20 described above primarily in that the device 220 employs a valve stem assembly 262 in which the outer member 282 thereof is bent. The bent outer member 282 results in an exit passageway 234 having a first straight portion 302, a curved portion 304, and a second straight portion 306. An axis C of the valve assembly 230 is defined as the center axis of the second straight portion 306 of the exit passageway 234.

When the valve member 230 is in its closed position, the axis C of the valve assembly 230 is offset at an angle of approximately 60 degrees from the center axis A of the aerosol device 220. But, as shown in FIG. 6, when the valve member is in its open position, the angle between these axes A and C reduces to approximately 45 degrees.

The advantage of this arrangement can be seen by a comparison of FIGS. 4 and 6. In FIG. 4, the angle between the surface of the drywall compound (horizontal) and the center axis A is approximately 40 degrees. This configuration of 5 FIG. 4 could thus allow the propellant 32 to enter the dip tube 70 with a large portion of the drywall component 22 still within the aerosol container 128.

On the other hand, in the third embodiment shown in FIG. 6, the angle between the surface of the drywall compound 222 (horizontal) and the Center axis A is approximately 15 degrees when the valve assembly 230 is in its open position. Accordingly, in comparison with the aerosol device 20, much more of the drywall compound 122 will normally be dispensed before the propellant 132 can enter the dip tube 170.

To accommodate the different geometry of the aerosol device 220, an angle between the surface 301 on the scraper member 244 and the exit axis C is different from the angle between the surface 101 on the scraper 44 and the exit axis B described above.

From the foregoing, it should be clear that the valve stem assembly 262 defining a curved exit passageway may also be used on the second embodiment shown in FIG. 5 if the circumstances require.

d. Optional Scraper Nozzle Configurations

Referring now to FIGS. 7–18, depicted therein are a number of scraper nozzle configurations that may be employed given such considerations as cost of the device and the configuration of the wall on which the irregularity has developed. Each of these scraper nozzles may be used in place of the scraper nozzles 44, 144, 244 of the aerosol devices 20, 120, and 220 described above.

In general, the scraper nozzles depicted in FIGS. 7–18 may simply be substituted for the upper member 82 of the valve stem assembly 62 and the nozzle member 44. Accordingly, the scraper nozzles shown and described below have an interior threaded portion adapted to engage the exterior threaded portion of the interior member 78.

Figure 7:
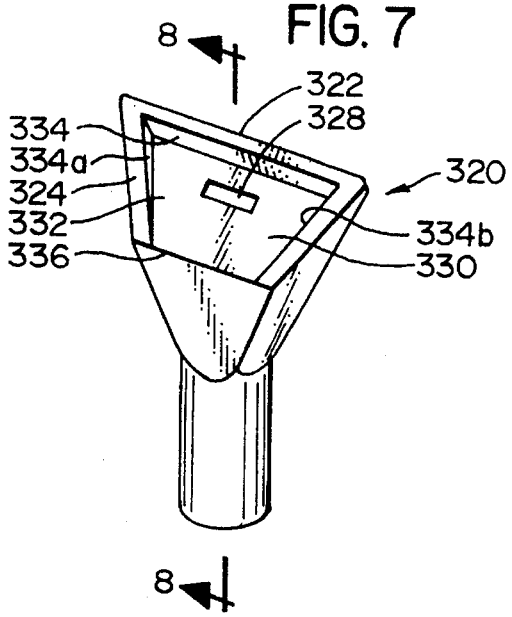
FIG. 7 is a perspective view of yet another scraper nozzle of the present invention.
Figure 8:
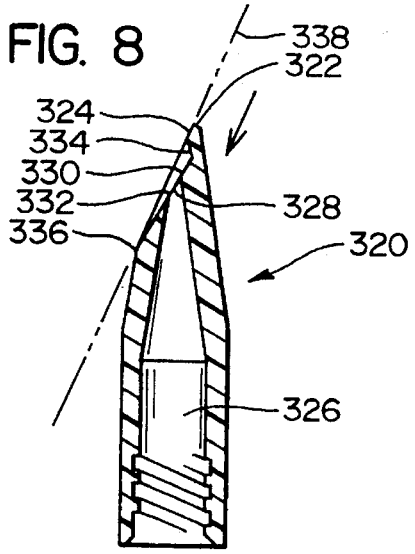
FIG. 8 is a side, cut-away view of the scraper nozzle shown in FIG. 7.

Referring initially to FIGS. 7 and 8, depicted therein is a scraper nozzle member 320. Formed on this scraper nozzle 320 is a scraper edge 322 and a scraper surface 324. Extending through the scraper nozzle 320 is a scraper passageway 326; the scraper passageway 326 has a lower end in communication with the exit passageway of the aerosol device on which the scraper nozzle 320 is mounted. The scraper passageway 326 terminates at its upper end in a scraper opening 328.

Formed on the scraper surface 324 is a cavity 330 defined by a cavity surface 332 and a cavity peripheral wall 334. The scraper opening 328 is coextensive with the cavity surface 332. The cavity surface 332 is canted with respect to the scraper surface 324 such that these surfaces intersect at a front edge 336 of the scraper nozzle 320. The cross-section of the scraper nozzle 320 is thus generally triangular, resulting in the cavity 330 being deeper near the scraper edge 322 than near the front edge 336. Additionally, portions **334*a* and 334*b* of the cavity peripheral wall 334 are outwardly and upwardly canted such that the cavity 330** formed thereby is flared.

As shown in FIG. 8, the scraper nozzle 320 is used in much the same manner as the nozzles 44, 144, 244 described above. The scraper surface 324 is placed against a wall surface 336 and drawn across an irregularity thereon as drywall compound is expelled from the aerosol container. But the scraper nozzle 320 allows drywall compound to accumulate within the cavity 330 before the scraper edge 322 forces the drywall compound into the irregularity.

If the scraper surface 324 of the scraper nozzle 320 is firmly held against a flat surface and drywall compound dispensed, this drywall compound will fill the cavity 330; when the cavity 330 is filled, further flow of drywall material out of the scraper opening 328 is stopped. The cavity 330 thus holds a reservoir of drywall compound that allows the scraper nozzle 320 to dispense drywall compound in a more consistent, regulated manner over a wider area.

In particular, as the store of drywall compound within the cavity 330 is drawn across and irregularity, pressure within the aerosol device forces the stored drywall compound into the irregularity, where it fills the irregularity completely and is subsequently smoothed by the cavity peripheral wall 334, scraper surface 324, and/or the scraper edge 322.

The cavity 330 spreads the drywall compound over a wide area as it is dispensed, allowing large, deep irregularities to be filled with one pass. Also, using a cavity such as the cavity 330 renders the application of drywall compound more predictable because it does not squirt to either side of the scraper opening 328 as may be the tendency without such a cavity 330.

The above-described configuration of the scraper nozzle 320 with a cavity 330 thus facilitates application of drywall material over an irregularity.

Figure 9:
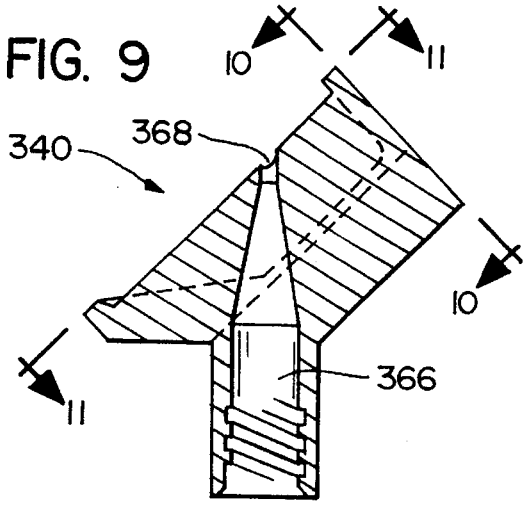
FIG. 9 is a side, cut-away view of another exemplary scraper nozzle constructed in accordance with the present invention.
Figure 10:
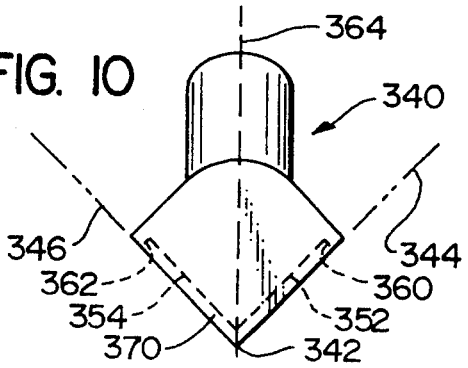
FIG. 10 is a plan view of the scraper nozzle shown in FIG. 9 taken along lines 10—10 therein.
Figure 11:
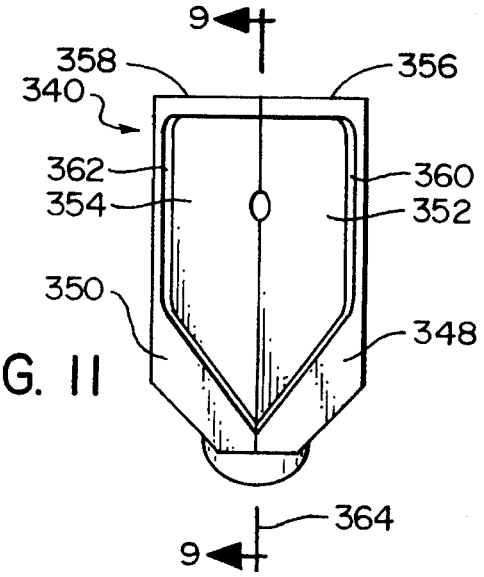
FIG. 11 is a plan view taken along lines 11—11 FIG. 9.

FIGS. 9–10 depict yet another scraper nozzle 340 of the present invention. This scraper nozzle 340 is particularly adapted to allow drywall compound to be applied to corner area 342 where two wall surfaces 344 and 346 intersect at a right angle (FIG. 10).

In particular, the scraper nozzle 340 comprises first and second scraper surfaces 348 and 350, first and second cavity surfaces 352 and 354, and first and second scraper edges 356 and 358. First and second cavity peripheral walls 360 and 362 extend around the first and second cavity surfaces 352 and 354, respectively. The first and second scraper surfaces 348 and 350, cavity surfaces 352 and 354, scraper edges 356 and 358, and cavity peripheral walls 360 and 362 all meet along a plane identified by reference character 364 in FIGS. 10 and 11 and defined by the drawing page in FIG. 9.

The scraper surfaces 348 and 350 extend at 90 degrees from each other and at 45 degrees to the plane 364. The exemplary cavity surfaces 352 and 354 are parallel to the scraper surfaces 348 and 350, but this need not be true in all cases.

A scraper passageway 366 extends through the scraper nozzle 340, terminating in a scraper opening 368 at the plane 364 where the cavity surfaces 354 and 352 intersect.

With the configuration just-described, a cavity 370 is formed when the scraper nozzle 340 is held against the wall surfaces 344 and 346 as shown in FIG. 10. With an irregularity located at the corner 342 or on the wall surfaces 344 or 346 adjacent to the corner 342, it should be clear that the configuration of the scraper nozzle 340 is particularly suited to apply drywall compound to such an irregularity.

The benefits of the cavity 370 are similar to those of the cavity 330 discussed above; however, it should be clear that the scraper nozzle 340 will operate without such a cavity 370.

Figure 12:
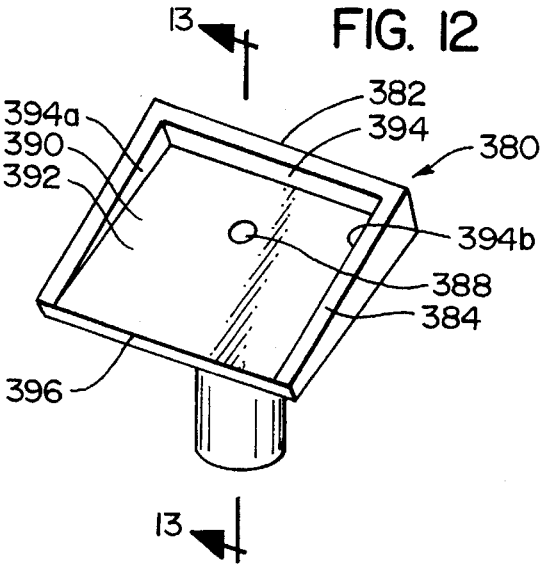
FIG. 12 is a perspective view of another exemplary scraper nozzle of the present invention.
Figure 13:
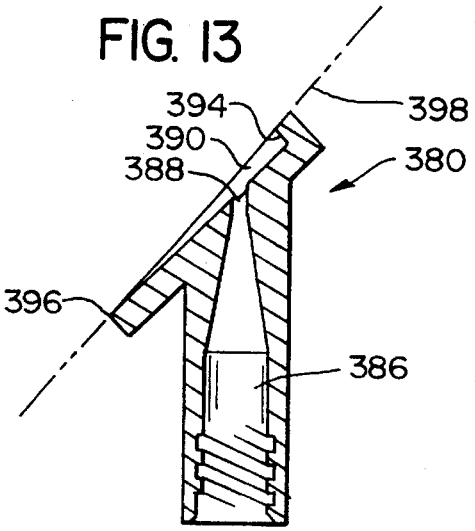
FIG. 13 is a side, cut-away view taken along lines 13—13 in FIG. 12.
Figure 14:
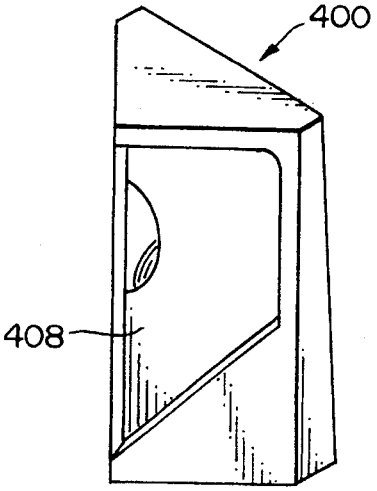
FIG. 14 is a perspective view of yet another scraper nozzle configuration constructed in accordance with the present invention.
Figure 15:
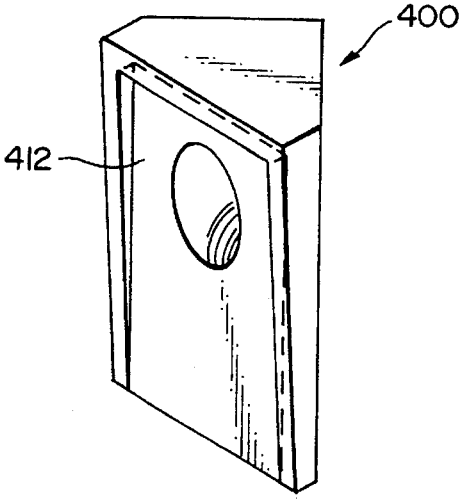
FIG. 15 is a perspective view of the scraper nozzle shown in FIG. 14 taken from a reversed angle.

Referring next to FIGS. 12 and 13, depicted therein is a scraper nozzle member 380. Formed on this scraper nozzle 380 is a scraper edge 382 and a scraper surface 384. Extending through the scraper nozzle 380 is a scraper passageway 386; the scraper passageway 386 terminates at its upper end in a scraper opening 388.

Formed on the scraper surface 384 is a cavity 398 defined by a cavity surface 392 and a cavity peripheral wall 394. The scraper opening 388 is coextensive with the cavity surface 392. The cavity surface 392 is canted with respect to the scraper surface 384 such that these surfaces intersect at a front edge 396 of the scraper nozzle 380. The cross-section of the cavity 390 is thus generally triangular, resulting in the cavity 330 being deeper near the scraper edge 382 than near the front edge 396.

From the above-discussion of the scraper nozzle 380, it can be seen that the scraper nozzle 380 is constructed in the same basic manner as the scraper nozzle 320 described above and shown in FIGS. 7 and 8.

The primary difference between these scraper nozzles 320 and 380 is that side portions **394*a* and 394*b* of the cavity peripheral wall 394 are parallel and not canted like the analogous peripheral wall portions portions 334*a* and 334*b* described above. The overall configuration of the cavity 390 from the front is thus generally square and not flared like that of the cavity 330 described above. Another difference between these two exemplary scraper nozzles 320 and 380 is that the scraper opening 388 is round and not rectangular like the opening 328. As shown in FIG. 13, the scraper nozzle 380 is used in much the same manner as the nozzles 44, 144, 244, and 320 described above. The scraper surface 384 is placed against a wall surface 398** and drawn across an irregularity thereon as drywall compound is expelled from the aerosol container.

Referring now to FIGS. 14–18, yet another exemplary scraper nozzle 400 is depicted therein. The scraper nozzle 400 is essentially a composite of the scraper nozzles 340 and 380 described above.

Figure 16:
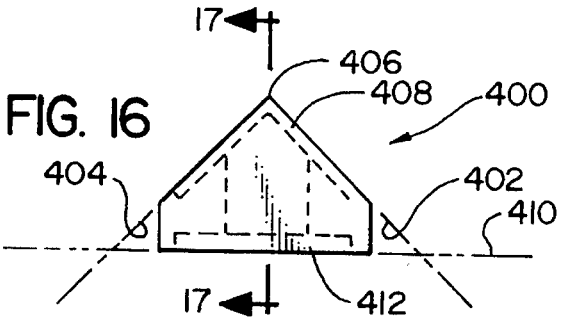
FIG. 16 is a top or bottom plan view showing how the scraper nozzle shown in FIGS. 14 and 15 engages either a corner area or a flat area of a wall depending on its orientation.

In particular, as perhaps best shown in FIG. 16, the scraper nozzle 400 is designed to apply drywall material to wall surfaces 402 and 404 that meet at a corner 406 when a first cavity 408 defined thereon is used and to flat wall surface 410 when a second cavity 412 defined thereon is used. The cavities 408 and 412 are constructed and operated in the same basic manner as the cavities 370 and 390 described above and will not be described again in further detail.

Figure 18:
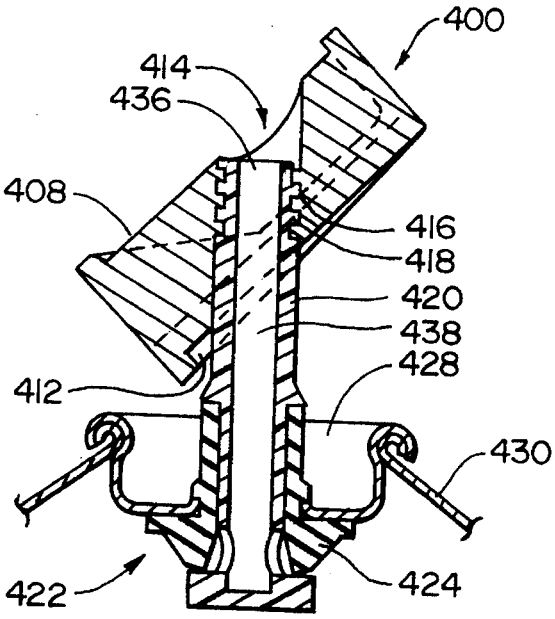
FIG. 18 is a side, cut-away view showing how the scraper nozzle shown in FIG. 17 engages an exemplary aerosol container and valve assembly.
Figure 17:
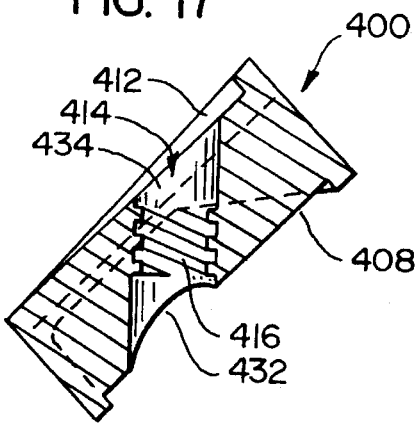
FIG. 17 iS a side, cut-away view taken along lines 17—17 in FIG. 16.

To allow two separate cavities to be used, a scraper passageway 414 extending through the scraper nozzle 400 is provided with a central threaded portion 416. A similar threaded portion 418 is formed on a valve member 420 as shown in FIG. 18. The valve member 420 forms part of a valve assembly 422 further comprising a resilient member 424 and a valve cap 428. The valve assembly 422 is attached to an aerosol container 430.

The valve assembly 422 is constructed and operates in the same basic manner as the valve assembly 130 described above and thus will not be described herein in further detail. It should be noted, however, that the scraper nozzle 400 will work equally well with the valve assembly 30 described above.

The threaded portion 416 on the scraper nozzle 400 is adapted to receive the threaded portion 418 on the valve member 420. More particularly, the scraper passageway 414 has a first end 432 that terminates in the first cavity 408 and a second end 434 that terminates in the second cavity 412. The valve member may be inserted into either of the first and second ends 432 and 434 of the scraper passageway 414 to engage the threaded portions 416 and 418.

The scraper nozzle 400 may thus be mounted in one of two configurations onto the valve member 420: in a first configuration, an outlet 436 of an exit passageway 438 extending through the valve member 420 is in communication with the first cavity 412 (FIG. 18); while in a second configuration, the outlet 436 of the exit passageway 438 is in communication with the second cavity 408. The scraper nozzle 400 may be changed by the end user at will between these first and second configurations simply by unthreading the scraper nozzle 400 from the valve member 420, reversing the scraper nozzle 400, and threading the scraper nozzle 400 back onto the valve member 420.

The primary advantage of the scraper nozzle 400 is that it is end user reconfigurable between the first and second configurations described above to cover irregularities either in a corner wall situation or on a flat wall surface.

Figure 19:
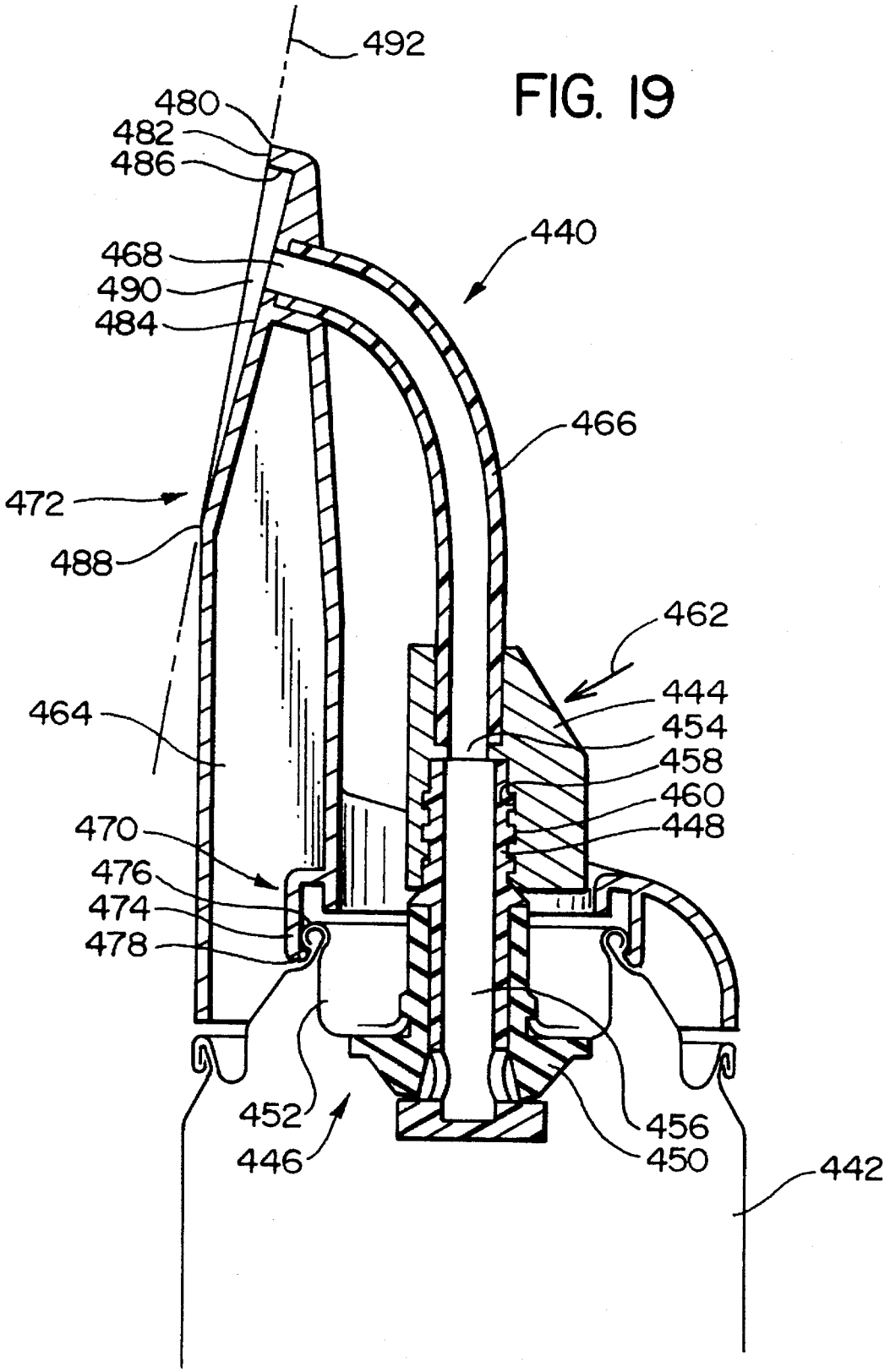
FIG. 19 is a side, cut-away view depicting a scraper nozzle in which the nozzle does not form part of the actuator system for the valve assembly.

Referring now to FIG. 19, yet another exemplary scraper nozzle 440 is shown therein. Unlike the scraper nozzles described above, the scraper nozzle 440 does not also form the actuator portion of the valve assembly employed.

Stated positively, the scraper nozzle 440 is rigidly connected to an aerosol container 442, while a separate actuator member 444 is provided to allow a valve assembly 446 to be placed into open and closed positions. Like the valve assembly 130 described above, the valve assembly 446 basically comprises a valve member 448, a resilient member 450, and a valve cap 452. The discussion above of the valve assembly 130 also applies to the valve assembly 446 and thus will not be repeated. It should be noted, however, that the valve assembly 30 described above can also be used with the scraper nozzle 440.

An actuator passageway 454 is formed in the actuator member 444; this actuator passageway 454 is in communication with an exit passageway 456 extending through the valve member 448. The actuator member 444 is internally threaded at 458 and the valve member 448 is externally threaded at 460; these threaded portions 458 and 460 mate to allow the actuator member 444 to be mounted on the valve member 448 as shown in FIG. 19.

By manually depressing the actuator member 444 in the direction shown by arrow 462, the valve assembly 446 may be placed in its open position to allow drywall compound to flow through the exit passageway 456 and into the actuator passageway 454.

The scraper nozzle 440 basically comprises a scraper member 464 and a nozzle tube 466. The scraper member 464 is adapted to be rigidly mounted onto the aerosol container 442.

The nozzle tube 466 is connected between the actuator member 444 and the scraper member 464 to allow fluid to flow from the actuator passageway 454 to a scraper opening 468 formed in the scraper member 464. The exemplary nozzle tube 466 is resilient to allow for the movement of the actuator member 444 necessary to place the valve assembly 446 into the open position. A pressure fit is formed where the tube 466 engages the actuator member 444 and the scraper member 464 to hold this tube 466 in place.

The scraper member 464 comprises a base portion 470 for engaging the aerosol container 442 and a scraper portion 472 to facilitate the application of drywall compound to a desired wall surface.

The scraper member base portion 470 comprises an annular wall 474 sized and configured to fit snugly around a rim 476 of the aerosol container 442. An inwardly projecting radial wall 478 is designed to engage the rim 476 to prevent inadvertent removal of the scraper member 464 from the aerosol container 442. But the annular wall 474 is somewhat resilient, and the scraper member 464 may be placed onto and removed from the aerosol container by the application of manual force sufficient to cause the annular wall to deflect enough to allow the radial wall 478 to be disengaged from the rim 476.

The scraper portion of the scraper member 464 may be formed in the shape of any of the scraper nozzles described above. The exemplary scraper portion 472 comprises a scraper edge 480, a scraper surface 482, a cavity surface 484, a cavity perimeter wall 486, and a front edge 488. The scraper opening 468 is coextensive with the cavity surface 484. The cavity surface 484 and cavity perimeter wall 486 define a cavity 490 that functions in the same manner as the cavities described above.

The scraper nozzle 440 is used in the following manner. The scraper portion 472 thereof is brought into contact with a wall surface 492; this can be accomplished simply be grasping the aerosol container 442, which is rigidly connected with the scraper member 464. A slight pressure is then applied to ensure that the scraper surface 484 tightly engages the wall surface 492.

The actuator member 462 is then depressed to allow drywall compound to flow through the nozzle tube 466, the scraper opening 468, and into the cavity 490. At the same time, the aerosol container 442 is displaced such that the cavity 490 passes over the irregularity to be covered.

The provision of an actuator member separate from a scraper member allows the user precise control of the flow of drywall compound. With the other configurations described above, the flow of drywall compound was dictated by the pressure needed to hold the scraper member against the wall containing the irregularity to be covered. Reducing the drywall compound flow rate required reduction of the pressure employed to hold the scraper nozzle against the wall. A reduction of the pressure employed to hold the scraper nozzle against the wall could result in drywall compound squirting to either side of the scraper nozzle during application or not being smoothly applied.

The advantage of the scraper nozzle shown in FIG. 19 is improved operation; the advantage of the other scraper nozzles is that they are simple to fabricate. The selection of a particular scraper nozzle in a given circumstance thus depends upon such factors as manufacturing costs and the need to optimize operational characteristics.

In all of the scraper nozzle configurations described above, the scraper nozzle is preferably manufactured out of injection molded material. This material may be a rigid or semi-rigid material such as plastic, or in some cases may be a resilient material such as polypropylene. If a resilient material is used, the material can flex as it passes over a textured surface; this flexing can improve the fluid seal between the scraper nozzle and the wall surface.

e. Method of Use

The basic method of use can be performed by any one of the embodiments described above. In any of these cases, the device is displaced such that the scraper edge of its scraper rests against the wall near the imperfection and the scraper surface is closely adjacent or abuts the wall surface.

The container is then manipulated such that when the valve assembly is in the open position; at the same time, the device is displaced such that the exit opening or cavity adjacent thereto moves over the irregularity. While the device is so displaced, the scraper edge is held against the wall so that the surface of the drywall compound is smooth and flat. When the scraper opening or cavity passes the irregularity, the resilient member is allowed to force the valve assembly into the close position.

It may then be necessary to clean the wall area surrounding the irregularity 24 with the scraper/nozzle member to ensure that the drywall compound surface is smooth. This is accomplished as described above except that the valve assembly is kept in the closed position. The drywall compound is then allowed to harden.

To prevent drywall compound that remains within the scraper passageway from hardening and clogging this passageway, the scraper/nozzle member may be removed from the outer member and rinsed with water. To prevent similar clogging of the exit passageway the exterior end thereof may be closed to prevent drying of the drywall compound therein. A cap may be formed on the scraper/nozzle member to facilitate covering of the exit passageway exterior end.

It should be clear from the foregoing that the present invention may be embodied in other specific forms without departing from the essential characteristics thereof. The present embodiments are therefore to be considered in all respects as illustrative and not restrictive, the scope of the invention being indicated by the appended claims rather than by the foregoing description; all changes which come within the meaning and range of equivalency of the claims are therefore intended to be embraced therein.

I claim:

1. An apparatus for applying spackle material to a surface, comprising:

an aerosol container defining a main chamber and having a valve opening formed therein;

valve means selectively operable between an open position and a closed position to open and close, respectively, an exit passageway extending through the valve opening from the main chamber to an exterior of the aerosol container, the exit passageway having an interior end and an exterior end;

wet spackle material arranged within the aerosol container; and propellant material arranged within the aerosol container; wherein when the valve means is in the open position, the propellant material expands to force the wet spackle material from the main chamber to the exterior of the aerosol container through the exit passageway; and the propellant material acts directly on the spackle material.

2. The apparatus as recited in claim 1, in which the propellant material is selected from the group of propellant materials consisting of compressed air and compressed nitrogen.

3. An apparatus for applying spackle material to a surface, comprising:

an aerosol container defining a main chamber and having a valve opening formed therein;

valve means selectively operable between an open position and a closed position to open and close, respectively, an exit passageway extending through the valve opening from the main chamber to an exterior of the aerosol container, the exit passageway having an interior end and an exterior end;

wet spackle material arranged within the aerosol container; and propellant material arranged within the aerosol container; wherein when the valve means is in the open position, the propellant material expands to force the wet spackle material from the main chamber to the exterior of the aerosol container through the exit passageway; and when the aerosol container is in an upright position, the wet spackle material is arranged in a lower region of the main chamber and the propellant material is arranged in an upper region of the main chamber, the apparatus further comprising:

a valve housing arranged within the upper region to define a valve chamber within the main chamber, where the valve chamber is in fluid communication with the exit passageway; and a dip tube having a first end connected to the valve housing and a second end extending into the lower region of the main chamber to define an initial passageway allowing fluid communication between the main chamber and the valve chamber; wherein when the aerosol container is in the upright position and the valve means is in the open position, the propellant material acts on the wet spackle material to force the wet spackle material through the initial passageway and into the valve chamber.

* * * * *